US005800272A

United States Patent [19]

Pons

[11] Patent Number: 5,800,272

[45] Date of Patent: Sep. 1, 1998

[54] MOTOR VEHICLE RACE TRACK HAVING A SUBSTANTIALLY "FIGURE EIGHT" CONFIGURATION

[76] Inventor: Edward Pons, 2807 35th Ave. West, Bradenton, Fla. 34205

[21] Appl. No.: 822,812

[22] Filed: Mar. 24, 1997

Related U.S. Application Data

[63] Continuation-in-part of Ser. No. 26,780, Aug. 5, 1994.

[51] Int. Cl.[6] ..... A63K 1/00

[52] U.S. Cl. ..... 472/85; 472/88

[58] Field of Search ..... 472/85, 86, 88, 472/89; 52/8; 14/78

[56] References Cited

U.S. PATENT DOCUMENTS

| | | | |
|---|---|---|---|
| D. 195,760 | 7/1963 | Martin . | |
| D. 204,468 | 4/1966 | Smedley . | |
| D. 233,620 | 11/1974 | Seki . | |
| D. 266,529 | 10/1982 | Aoki . | |
| D. 275,692 | 9/1984 | Kanaoki . | |
| 483,600 | 10/1892 | Butler | 472/86 |
| 809,588 | 1/1906 | Thomas et al. . | |
| 877,993 | 2/1908 | Georges . | |
| 2,106,424 | 1/1938 | Einfalt . | |
| 2,218,164 | 10/1940 | Carpenter . | |
| 3,775,897 | 12/1973 | Soulakis et al. . | |
| 4,423,871 | 1/1984 | Mucaro . | |

OTHER PUBLICATIONS

Printed Publication "A New Look for Existing Stadiums," p. 3 of Miracle catalog believed to have been received at the United States Patent and Trademark Office May. 1996 (D25/12).

Printed Publication "A Modern Look for New Stadiums," p. 4 of Miracle catalog believed to have been received at the United States Patent and Trademark Office May 1996 (D25/12).

*Primary Examiner*—Kien T. Nguyen

*Attorney, Agent, or Firm*—Oldham & Oldham Co., L.P.A.

[57] ABSTRACT

Motor vehicle track having a substantially "figure eight" configuration which includes a underpass and an overpass at different elevational levels at the intersection of the substantially "figure eight" configuration. Such a motor vehicle race track forms an enclosed loop which would be, preferably, be at least one half mile in length and three (3) miles or less in length and would accommodate motor vehicles having engines which generate in excess of 100 horsepower. Spectator seating would be provided around at least a portion, and perhaps the entire perimeter, of the motor vehicle race track and many spectators seats would permit spectators to view a substantial portion of motor vehicle race track.

28 Claims, 5 Drawing Sheets

MOTOR VEHICLE RACE TRACK HAVING A SUBSTANTIALLY "FIGURE EIGHT" CONFIGURATION

BACKGROUND AND SUMMARY OF THE INVENTION

This is a continuation-in-part of copending design patent application Serial No. 29/026,780 filed on Aug. 5, 1994.

The present invention relates generally to a new and novel motor vehicle race track having a substantially "figure eight" configuration. More particularly, the present invention relates to a new and novel motor vehicle race track having a substantially "figure eight" configuration which includes a underpass and an overpass at the intersection of the substantially "figure eight" configuration to allow the motor vehicles to pass at different elevational levels at the intersection of the substantially "figure eight" configuration.

One of the most popular, and fastest growing, spectator sports in the United States, as well as in other parts of the world, is motor vehicle racing. In the United States, stock cars sanctioned by the National Association of Stock Car Automobile Racing (NASCAR) qualify in time trials and race at various race tracks across the country before millions of spectators each year. Similarly, sports cars sanctioned by organizations such as Championship Automobile Racing Teams (CART) and Indy Racing League (IRL) hold time trials and race on some of the same race tracks, as well as others, again before millions of spectators each year. Furthermore, international organizations, such as the Grand Prix circuit, sanction motor vehicle time trials and races in various countries throughout the world before millions of spectators. In addition to these national and international motor vehicle racing sanctioning organizations, there are hundreds, and perhaps even thousands, of other smaller stock and sports car race tracks located throughout the United States and in other countries around the world which hold motor vehicle time trials and races which are viewed by spectators. At the present time, various geographic areas are building new motor vehicle race tracks in an attempt to attract some of the major motor vehicle races to their geographic areas.

Currently, the vast majority of motor vehicle race tracks are of two (2) basic types. The first type is represented by the famous Indianapolis 500 race track in Speedway, Ind. Motor vehicle race tracks of this type are generally "oval" or "circular" in configuration and form an enclosed loop. One (1) lap in this first type of motor vehicle race tracks is generally anywhere from one half mile to three (3) miles in length. In this first type of motor vehicle race tracks, spectator stands are generally positioned around at least a portion, if not the entire, perimeter of the race track and smaller spectator stands or a fence is generally placed around the interior of the motor vehicle race track to allow spectators to view the motor vehicle time trials or race from the "infield" or the interior of the motor vehicle race track. These first type of race tracks allow relatively high motor vehicle speeds since they generally include at least two (2) straightaways and are relatively compact in area. From a spectator's point of view, most spectator seats allow a spectator to view a relatively large portion of the motor vehicle race track, particularly from those spectator seats around the perimeter of the motor vehicle race track in the corners. However, this first type of motor vehicle race tracks include turns in only one direction, most usually all left turns, but, if desired, a motor vehicle race track of this first type could include all right turns. This results in motor vehicles which are intentionally set up to be "unbalanced" to facilitate, most usually, all left turns. This can result in more wear and tear to the tires and other structural components on one side of the motor vehicle as compared to the tires and other components on the other side of the motor vehicle. In addition, driver's skills are not challenged to the same extent as they would be in a motor vehicle race track which would require both left turns and right turns.

The second type of motor vehicle race tracks is illustrated by the motor vehicle race track in Watkins Glen, N.Y., which is a road race track and generally includes a variety of turns in different directions and having different radii. Motor vehicle race tracks of this second type also generally include elevational changes and are generally longer, and are therefore spread out over a larger area, than motor vehicle race tracks of the first type described above. Since motor vehicle race tracks of the second type generally include more turns and shorter and fewer straightaways, the average motor vehicle race speeds for comparable motor vehicles would generally be less that they would be on a motor vehicle race track of the first type having an enclosed loop of a comparable distance. In addition, in motor vehicle race tracks of this second type, spectators generally view the motor vehicle time trials or race from a particular location on the motor vehicle race track and a substantial portion of the motor vehicle race track cannot be viewed from most spectator seats. However, motor vehicle race tracks of this second type have become quite popular to participants and spectators because, since both right and left turns are necessary, such motor vehicle race tracks provide a better test for both drivers, as well as their equipment, and, in order to be competitive, both have to be capable of making right, as well as, left turns.

A third type of motor vehicle race track known to applicant does have a substantially "figure eight" configuration, but the intersection of the substantially "figure eight" configuration is at the same elevational level. Motor vehicle race tracks of this third type are typically relatively short as compared to the other two (2) types of motor vehicle race tracks described above. This is done, at least in part, to reduce the average motor vehicle speeds since the motor vehicles must, hopefully, pass in front of or behind, motor vehicles traveling along the other straightaway at the intersection of the substantially "figure eight" configuration. This does not always occur and, on occasion, motor vehicle race tracks of this third type provide entertainment to spectators when two or more motor vehicles meet at the intersection of the substantially "figure eight" configuration and collide. However, because of safety concerns, as well as the cost of more sophisticated racing motor vehicles which travel at higher average speeds, motor vehicle racing tracks of this third type have not been widely accepted.

Accordingly, an object of the present invention is the provision of motor vehicle race track which requires the motor vehicles to make both right, as well as left, turns in the course of completing an enclosed loop.

Another object of the present invention is the provision of motor vehicle race track which is relatively compact in area and provides a large number of spectator seats which provide spectators with a view of a substantial portion of the motor vehicle race track.

These and other objects of the present invention are attained by the provision of a motor vehicle race track having a substantially "figure eight" configuration which includes a underpass and an overpass at different elevational levels at the intersection of the substantially "figure eight"

configuration. Such a motor vehicle race track forms an enclosed loop which would be, preferably, at least one half mile in length and no more that three (3) miles in length and would accommodate motor vehicles having engines which generate in excess of 100 horsepower. Spectator seating would be provided around at least a portion, and perhaps the entire perimeter, of the motor vehicle race track and many spectator seats would permit spectators to view a substantial portion of motor vehicle race track.

Other advantages and novel features of the present invention will become apparent in the following detailed description of the invention when considered in conjunction with the accompanying drawings.

DETAILED DESCRIPTION OF THE DRAWINGS

Figure 1:
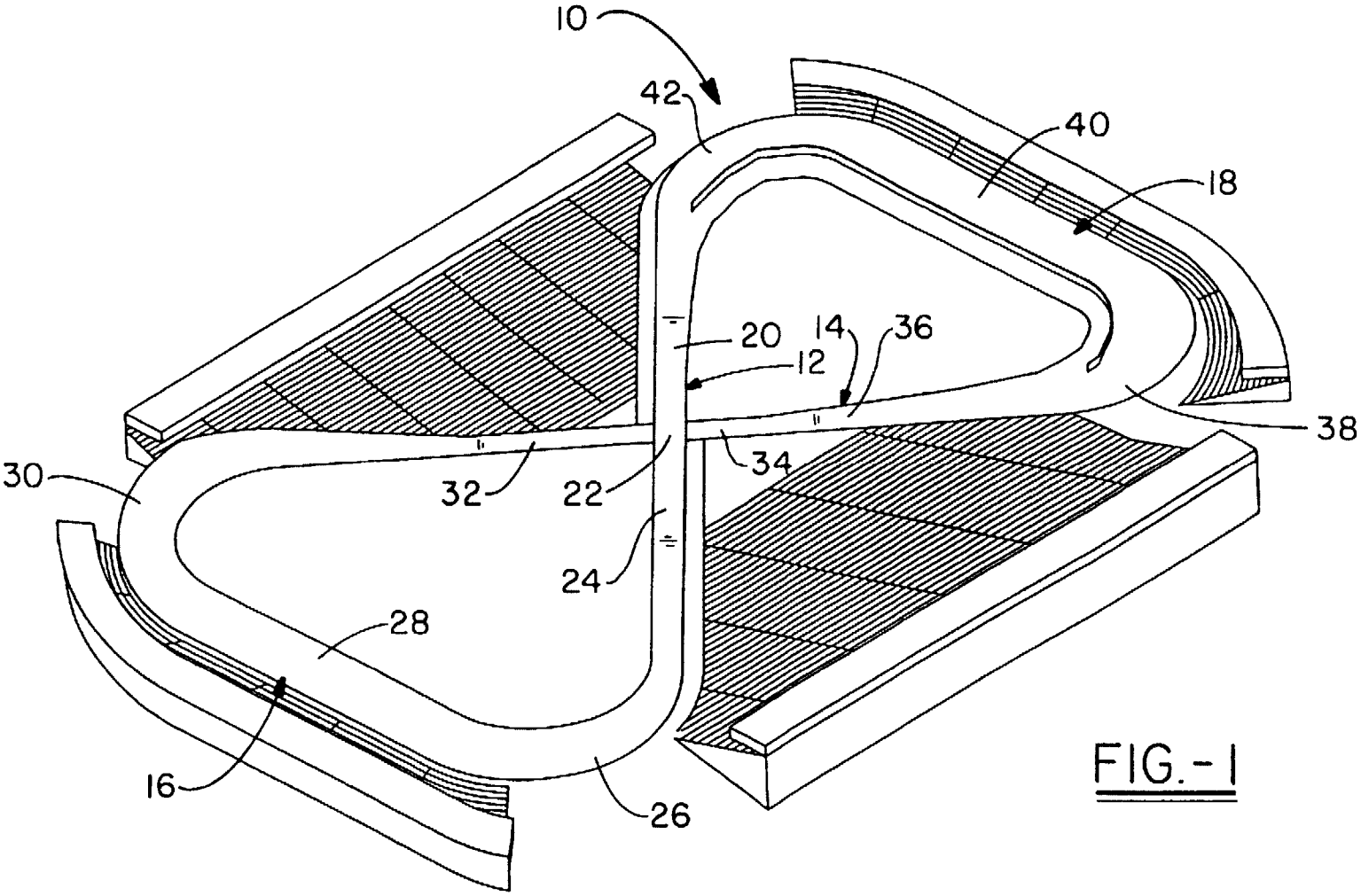
FIG. 1 illustrates a top perspective view of a motor vehicle race track having a substantially "figure eight" configuration in accordance with a first preferred embodiment of the present invention.

In the following detailed description of preferred embodiments of the present invention, reference is made to the accompanying drawings which, in conjunction with this detailed description, illustrate and describe a first and a second preferred embodiment of a motor vehicle race track having a substantially "figure eight" configuration in accordance with the present invention. Referring first to FIGS. 1 through 4, which illustrate a top perspective view, a top plan view, an end perspective view and a side perspective view, respectively, of a motor vehicle race track having a substantially "figure eight" configuration, generally identified by reference number 10, in accordance with a first preferred embodiment of the present invention, motor vehicle race track having a substantially "figure eight" configuration 10 forms an enclosed loop and generally includes first straightaway 12, second straightaway 14, first end portion 16 and second end portion 18. It should be noted that the phrase "enclosed loop," as used in this patent application, refers to the fact that the motor vehicle race track forms an enclosed lap, such that motor vehicles which start at a particular location on the motor vehicle race track periodically pass by that same location after completing the "enclosed loop," and does not imply that the overall configuration of the motor vehicle race track is substantially "circular."

In the preferred embodiment of motor vehicle race track having a substantially "figure eight" configuration 10 shown in FIGS. 1 through 4, first straightaway 12 passes above second straightaway 14 to allow motor vehicles to pass the intersection of the substantially "figure eight" configuration at different elevational levels, thus avoiding collisions at this intersection. This is accomplished by first straightaway 12 having first gradual ascent portion 20 which ascends, for example, a distance of two and one half to twelve and one half feet, over a relatively extended distance to pass above second straightaway 14 at the point of intersection of the substantially "figure eight" configuration. First gradual ascent portion 20 transitions in the region above second straightaway 14 into first relatively level portion 22 which, in turn, transitions into first gradual descent portion 24. As seen in FIGS. 1 through 4, first gradual descent portion 24 transitions into first right turn 26 in first end portion 16 and, if desired, into first end straightaway 28 which is preferably shorter than first straightaway 12 and second straightaway 14. First end straightaway 28 transitions into second right turn 30 which transitions into second gradual descent portion 32, which preferably descends by approximately the same amount as first gradual ascent portion 20, for example, two and one half to twelve and one half feet. Second gradual descent portion 32 transitions into second relatively level portion 34 in the region of the intersection of the substantially "figure eight" configuration which passes under first straightaway 12 and transitions into second gradual ascent portion 36. Second gradual ascent portion 36 transitions into first left turn 38 in second end portion 18 which, if desired, transitions into second end straightaway 40 which is preferably shorter than first straightaway 12 and second straightaway 14. Second end straightaway 40 transitions into second left turn 42 which, in turn, transitions into first gradual ascent portion 20 of first straightaway 12 and, thus, one lap is completed.

Figure 5:
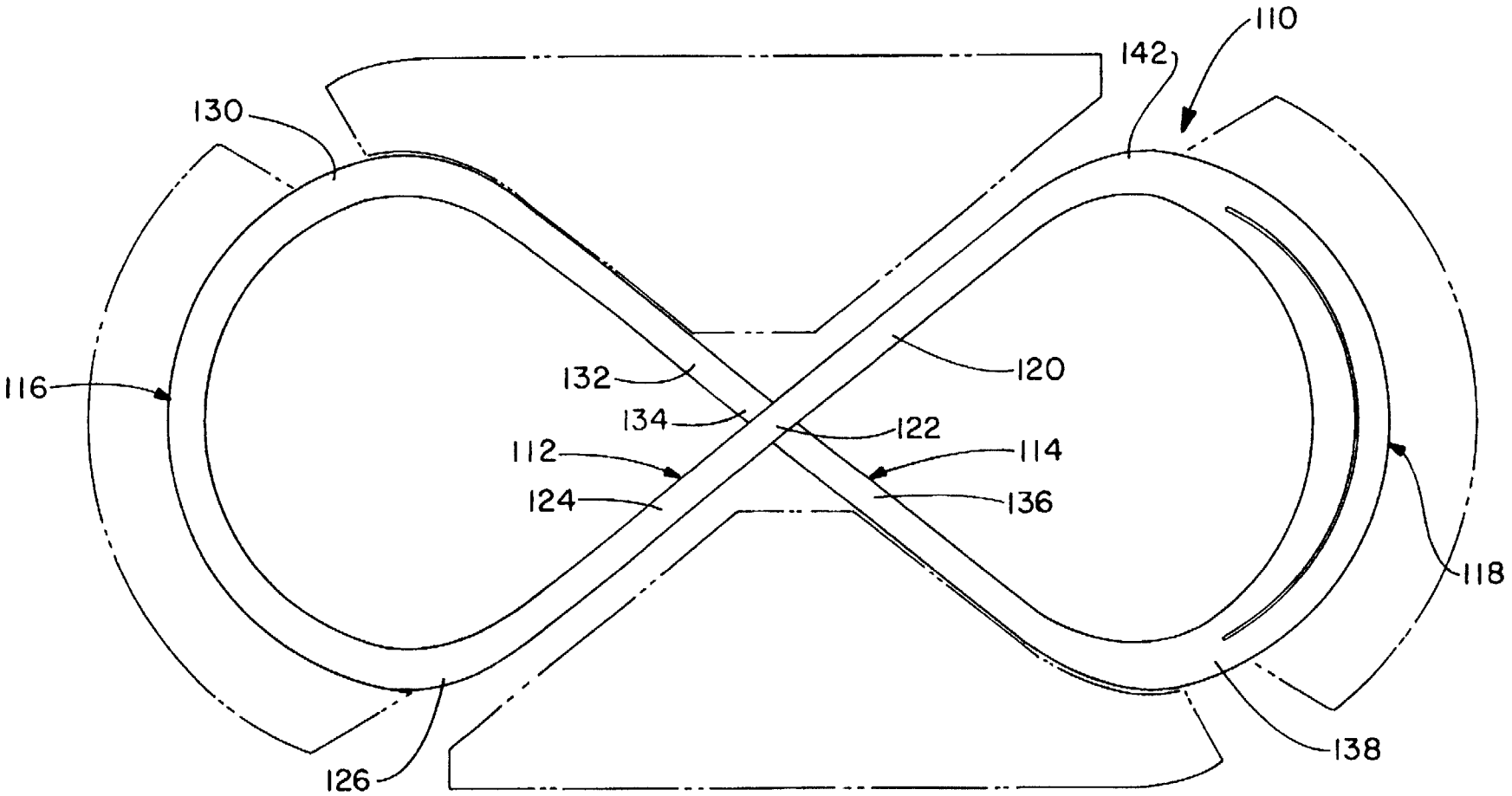
FIG. 5 illustrates a top plan view of a motor vehicle race track having a substantially "figure eight" configuration in accordance with a second preferred embodiment of the present invention.

Referring now to FIG. 5, a variation of motor vehicle race track having a substantially "figure eight" configuration is shown, indicated generally by reference number 110, in accordance with a second preferred embodiment of the present invention, motor vehicle race track having a substantially "figure eight" configuration 110 forms an enclosed loop and generally includes first straightaway 112, second straightaway 114, first end portion 116 and second end portion 118.

In the preferred embodiment of motor vehicle race track having a substantially "figure eight" configuration 110 shown in FIG. 5, first straightaway 112 passes above second straightaway 114 to allow motor vehicles to pass the intersection of the "figure eight" configuration at different elevational levels, thus avoiding collisions at this intersection. This is accomplished by first straightaway 112 having first gradual ascent portion 120 which ascends, for example, a distance of two and one half to twelve and one half feet, over a relatively extended distance to pass above second straightaway 114 at the point of intersection of the substantially "figure eight" configuration. First gradual ascent portion 120 transitions in the region above second straightaway 114 into first relatively level portion 122 which, in turn, transitions into first gradual descent portion 124. First gradual descent portion 124 transitions into first right turn 126 in first end portion 116 which preferably maintains a relatively constant radius throughout first end portion 116. First right turn 126 transitions into second gradual descent portion 132, which preferably descends by approximately the same amount as first gradual ascent portion 120, for example two and one half to twelve and one half feet. Second gradual descent portion 132 transitions into second relatively level portion 134 in the region of the intersection of the substantially "figure eight" configuration which passes under first straightaway 112 and transitions into second gradual ascent portion 136. Second gradual ascent portion 136 transitions into first left turn 138 in second end portion 118 which preferably maintains a relatively constant radius throughout second end portion 118. First left turn 138 transitions into first gradual ascent portion 120 of first straightaway 112 and, thus, one lap is completed.

In each of the preferred embodiments of motor vehicle race tracks having a substantial "figure eight" configuration described above, one lap is preferably one half mile or greater in length, but no longer than three (3) miles in length. More preferably, one lap would be between one and one half miles and two and one half miles in length, and most preferably, one lap would be approximately two (2) miles in length. For the most preferred lap length of approximately two (2) miles in length, first straightaway 12 and 112 and second straightaway 14 and 114 would preferably each have a length of approximately ⅔ of a mile and first end portion 16 and 116 and second end portion 18 and 118 would preferably each have a length of approximately ⅓ of a mile. The width of the racing surface is preferably substantially uniform around motor vehicle race track having a substantially "figure eight" configuration 10 and 110, and is between 50 feet and 150 feet wide, most preferably being approximately 100 feet wide. The clearance between the underpass and the overpass at the intersection of the substantially "figure eight" configuration is preferably between five (5) feet and twenty five (25) feet, more preferably between ten (10) and twenty (20) feet, and, most preferably, approximately fifteen (15) feet. Motor vehicle race track having a substantially "figure eight" configuration 10 and 110 is envisioned to be utilized primarily for the financial gain of motor vehicle racing competitors and for spectators viewing such motor vehicle racing competitions and not primarily for recreational and amusement use. Accordingly, motor vehicles competing on motor vehicle race track having a substantially "figure eight" configuration 10 and 110 would generally have engines which generate in excess of 100 horsepower and such motor vehicles would generally travel at an average speed in excess of fifty (50) miles per hour and, more preferably, at an average speed in excess of eighty (80) miles per hour. Such motor vehicle races would generally be sanctioned by a governing body and would be viewed by paying spectators. At least a portion of the perimeter of motor vehicle race track having a substantially "figure eight" configuration 10 and 110 would, most preferably, be substantially surrounded by spectator seating which would accommodate between 1,000 and 500,000 spectators for a motor vehicle race or qualifying event.

Figure 2:
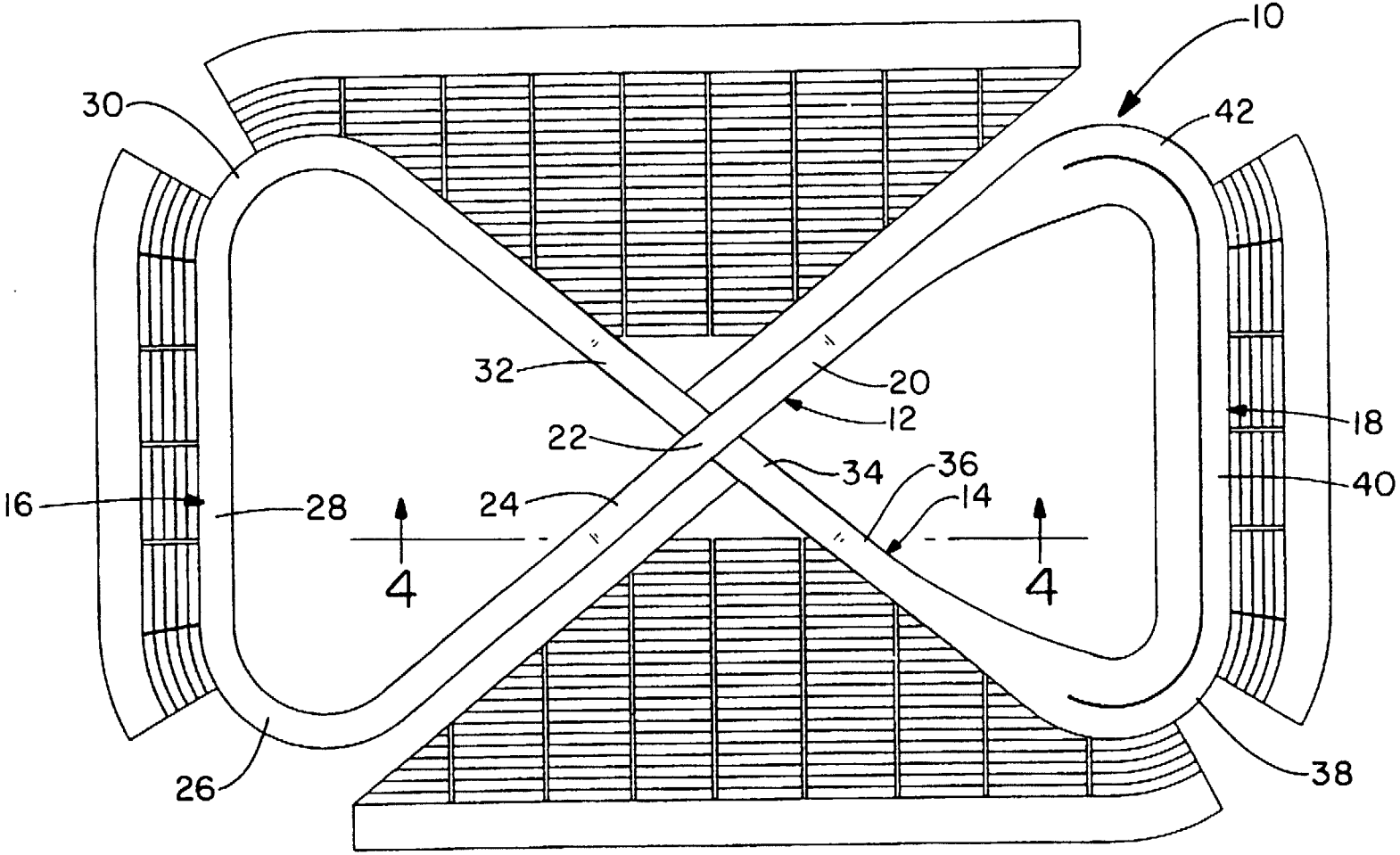
FIG. 2 illustrates a top plan view of the motor vehicle race track having a substantially "figure eight" configuration in accordance with the first preferred embodiment of the present invention shown in FIG. 1.
Figure 3:
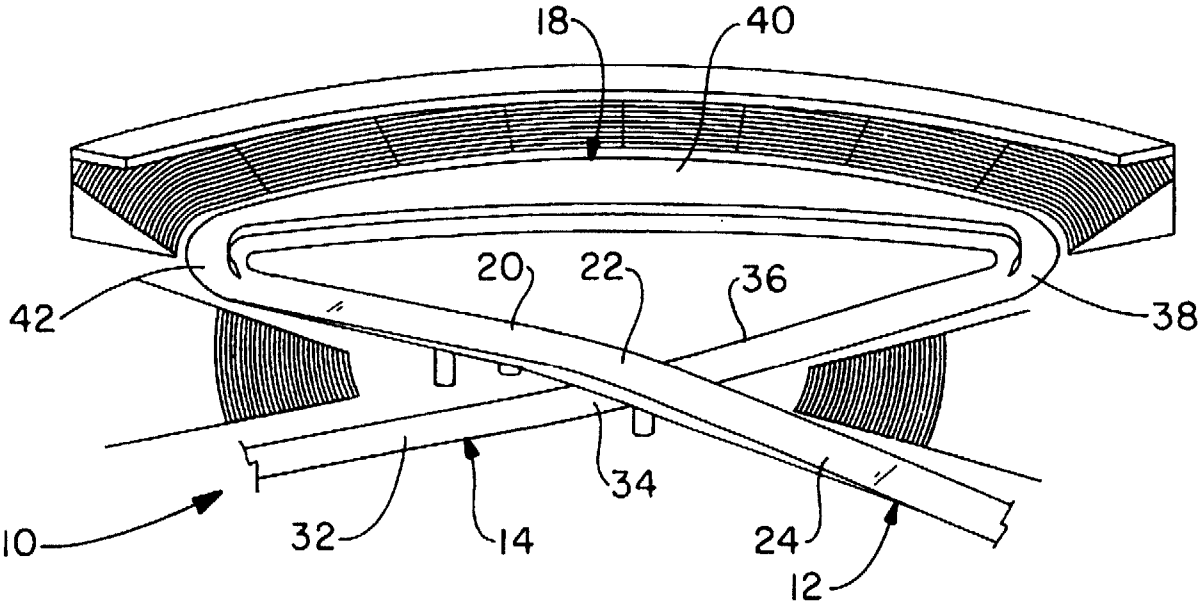
FIG. 3 illustrates an end perspective view of the motor vehicle race track having a substantially "figure eight" configuration in accordance with the first preferred embodiment of the present invention shown in FIG. 1.
Figure 4:
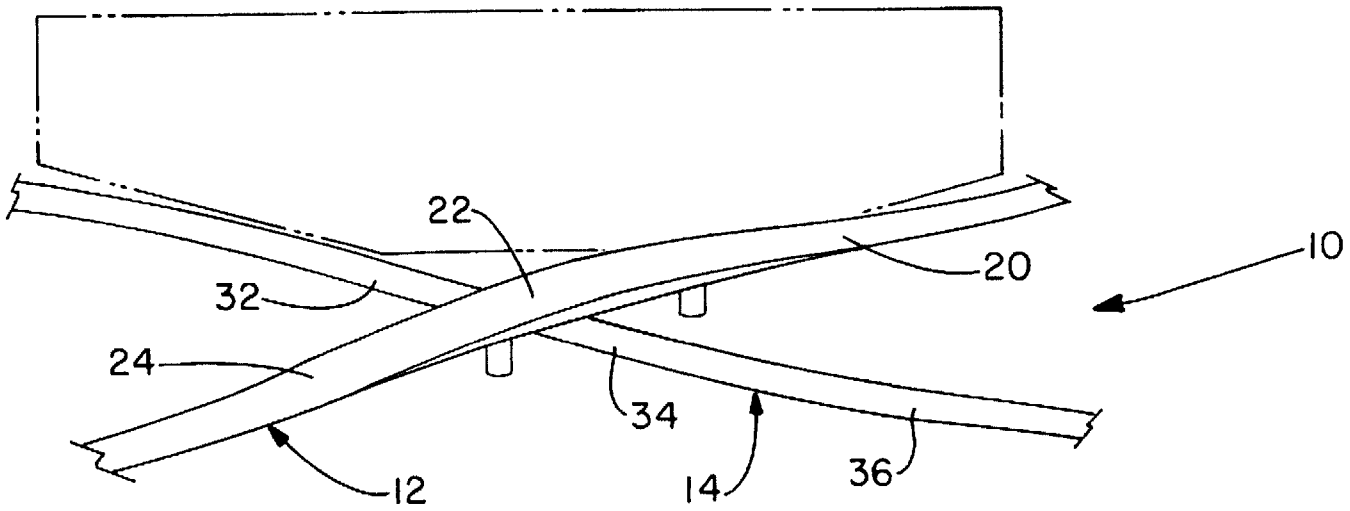
FIG. 4 illustrates a perspective view taken in the direction of 4—4 in FIG. 2 of the motor vehicle race track having a substantially "figure eight" configuration in accordance with the first preferred embodiment of the present invention shown in FIG. 1.

The race track surface would preferably be designed for the racing of motorized vehicles and motorcycles having engines which generate over 100 horsepower and would, most preferably, be surfaced with asphalt, concrete or some other material having the ability to support and maintain its original shape when used by motor vehicles which weight at least 800 pounds. In addition, to enhance the average speed of the motor vehicles racing, one or more of the corners could be banked, preferably between 10 degrees and 40 degrees, and most preferably, 25 degrees. The preferred embodiments of motor vehicle race tracks having a substantially "figure eight" configuration 10 and 110 described above are substantially symmetrical and first straightaway 12 and 112 and second straightaway 14 and 114 are substantially equal in length. In addition, first end portion 16 and 116 and second end portion 18 and 118 are substantially similar in radius, banking and configuration. Thus, the preferred embodiments of motor vehicle race tracks having a substantially "figure eight" configuration 10 and 110 are substantially symmetrical motor vehicle race tracks. However, it will be readily recognized by those having a level of ordinary skill in the art that, if desired, the straightaways could be made different lengths and/or the first end portion could be made to have a different radius, banking or configuration than the second end portion by utilizing the teachings present in the present patent application. For example, if desired, first end portion 16 of motor vehicle race track having a substantially "figure eight" configuration 10 could be used in conjunction with second end portion 118 of motor vehicle race track having a substantially "figure eight" configuration 110, if desired. Furthermore, as shown in FIGS. 1, 2 and 5, a path to permit motor vehicle and spectator movement from the outside of the motor vehicle race track to the interior of the motor vehicle race track is preferably provided below the motor vehicle race track surface to permit movement therebetween without crossing the motor vehicle race track. In addition, a "pit row" or motor vehicle refueling, maintenance and repair area could be positioned along one of the end portions as shown in FIGS. 1, 2 and 5 or, if preferred, such a "pit row" or motor vehicle refueling, maintenance and repair area could be provided along one of the straightaways. It should also be noted that safety features, including guardrails, perimeter walls, fences and protective barriers, would preferably be used in conjunction with motor vehicle race track having a substantially "figure eight" configuration 10 and 110. Such safety features have not been shown in the drawing figures of motor vehicle race track having a substantially "figure eight" configuration 10 and 110 so as not to obscure the novel and non-obvious aspects of the present invention as described herein and such safety features would currently be anticipated as being of conventional design.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A motor vehicle race track having a substantially "figure eight" configuration, comprising a first straightaway which transitions into a first end portion which transitions into a second straightaway which transitions into a second end portion to form an enclosed loop and said first straightaway passes above said second straightaway at the intersection of the "figure eight" configuration and said first end portion and said second end portion each have a substantially "hour glass" configuration and each include a first end turn, an end straightaway and a second end turn.

2. The motor vehicle race track having a substantially "figure eight" configuration in accordance with claim 1, wherein said enclosed loop is one half mile or greater in length.

3. The motor vehicle race track having a substantially "figure eight" configuration in accordance with claim 1, wherein said enclosed loop is no longer than three (3) miles in length.

4. The motor vehicle race track having a substantially "figure eight" configuration in accordance with claim 1, wherein said enclosed loop is approximately two miles in length.

5. The motor vehicle race track having a substantially "figure eight" configuration in accordance with claim 1, wherein the width of said motor vehicle race track having a substantially "figure eight" configuration is at least fifty (50) feet.

6. The motor vehicle race track having a substantially "figure eight" configuration in accordance with claim 1, wherein the width of said motor vehicle race track having a substantially "figure eight" configuration is no greater than one hundred fifty (150) feet.

7. The motor vehicle race track having a substantially "figure eight" configuration in accordance with claim 1, wherein the width of said motor vehicle race track having a substantially "figure eight" configuration is approximately one hundred (100) feet.

8. The motor vehicle race track having a substantially "figure eight" configuration in accordance with claim 1, wherein the clearance between said first straightaway and said second straightaway at the intersection of the substantially "figure eight" configuration is five (5) feet or greater.

9. The motor vehicle race track having a substantially "figure eight" configuration in accordance with claim 1, wherein the clearance between said first straightaway and said second straightaway at the intersection of the substantially "figure eight" configuration is no greater than twenty five (25) feet.

10. The motor vehicle race track having a substantially "figure eight" configuration in accordance with claim 1, wherein the clearance between said first straightaway and said second straightaway at the intersection of the substantially "figure eight" configuration is approximately fifteen (15) feet.

11. The motor vehicle race track having a substantially "figure eight" configuration in accordance with claim 1, wherein at least a portion of the perimeter of said motor vehicle race track having a substantially "figure eight" configuration includes spectator seating which will accommodate between 1,000 and 500,000 spectators.

12. The motor vehicle race track having a substantially "figure eight" configuration in accordance with claim 1, wherein said first turns and said second turns are banked in a range of from 10 degrees to 40 degrees.

13. The motor vehicle race track having a substantially "figure eight" configuration in accordance with claim 1, wherein said first turns and said second turns are banked at an angle of approximately 25 degrees.

14. The motor vehicle race track having a substantially "figure eight" configuration in accordance with claim 1, wherein said first end portion and said second end portion of said motor vehicle race track having a substantially "figure eight" configuration are substantially symmetrical in configuration.

15. A motor vehicle race track having a substantially "figure eight" configuration, comprising a first straightaway which transitions into a first end portion which transitions into a second straightaway which transitions into a second end portion to form an enclosed loop and said first straightaway passes above said second straightaway at the intersection of the "figure eight" configuration wherein said first end portion and said second end portion have a substantially continuous radius and at least a portion of at least one of said first end portion and said second end portion is banked in a range from 10 degrees to 40 degrees.

16. The motor vehicle race track having a substantially "figure eight" configuration in accordance with claim 15, wherein said enclosed loop is one half mile or greater in length.

17. The motor vehicle race track having a substantially "figure eight" configuration in accordance with claim 15, wherein said enclosed loop is no longer than three (3) miles in length.

18. The motor vehicle race track having a substantially "figure eight" configuration in accordance with claim 15, wherein said enclosed loop is approximately two miles in length.

19. The motor vehicle race track having a substantially "figure eight" configuration in accordance with claim 15, wherein the width of said motor vehicle race track having a substantially "figure eight" configuration is at least fifty (50) feet.

20. The motor vehicle race track having a substantially "figure eight" configuration in accordance with claim 15, wherein the width of said motor vehicle race track having a substantially "figure eight" configuration is no greater than one hundred fifty (150) feet.

21. The motor vehicle race track having a substantially "figure eight" configuration in accordance with claim 15, wherein the width of said motor vehicle race track having a substantially "figure eight" configuration is approximately one hundred (100) feet.

22. The motor vehicle race track having a substantially "figure eight" configuration in accordance with claim 15, wherein the clearance between said first straightaway and said second straightaway at the intersection of the substantially "figure eight" configuration is five (5) feet or greater.

23. The motor vehicle race track having a substantially "figure eight" configuration in accordance with claim 15, wherein the clearance between said first straightaway and said second straightaway at the intersection of the substantially "figure eight" configuration is no greater than twenty five (25) feet.

24. The motor vehicle race track having a substantially "figure eight" configuration in accordance with claim 15, wherein the clearance between said first straightaway and said second straightaway at the intersection of the substantially "figure eight" configuration is approximately fifteen (15) feet.

25. The motor vehicle race track having a substantially "figure eight" configuration in accordance with claim 15, wherein at least a portion of the perimeter of said motor vehicle race track having a substantially "figure eight" configuration includes spectator seating which will accommodate between 1,000 and 500,000 spectators.

26. The motor vehicle race track having a substantially "figure eight" configuration in accordance with claim 15, wherein each of said first end portion and said second end portion are banked at an angle of approximately 25 degrees.

27. The motor vehicle race track having a substantially "figure eight" configuration in accordance with claim 15, wherein said first end portion and said second end portion of said motor vehicle race track having a substantially "figure eight" configuration are substantially symmetrical in configuration.

28. A motor vehicle race track having a substantially "figure eight" configuration, comprising a first straightaway which transitions into a first end portion which transitions into a second straightaway which transitions into a second end portion to form an enclosed loop and said first straightaway passes above said second straightaway at the intersection of the "figure eight" configuration and said first end portion has a substantially "hour glass" configuration having a first end turn, an end straightaway and a second end turn and said second end portion has a substantially continuous radius.

* * * * *